US011186085B2

(12) United States Patent
Hayashi

(10) Patent No.: US 11,186,085 B2
(45) Date of Patent: Nov. 30, 2021

(54) HEAD

(71) Applicant: BROTHER KOGYO KABUSHIKI KAISHA, Nagoya (JP)

(72) Inventor: Hideki Hayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 14 days.

(21) Appl. No.: 16/587,180

(22) Filed: Sep. 30, 2019

(65) Prior Publication Data

US 2020/0189273 A1 Jun. 18, 2020

(30) Foreign Application Priority Data

Dec. 18, 2018 (JP) ..... JP2018-236110

(51) Int. Cl.
*B41J 2/14* (2006.01)
*B41J 2/16* (2006.01)

(52) U.S. Cl.
CPC ..... *B41J 2/1433* (2013.01); *B41J 2/1623* (2013.01); *B41J 2202/11* (2013.01)

(58) Field of Classification Search
CPC ..... B41J 2/1433; B41J 2/1623; B41J 2202/11
See application file for complete search history.

(56) References Cited

U.S. PATENT DOCUMENTS

| | | | | |
|---|---|---|---|---|
| 10,906,309 | B2 * | 2/2021 | Hayashi | B41J 2/14032 |
| 2015/0306875 | A1 | 10/2015 | Nishimura et al. | |
| 2019/0291424 | A1 * | 9/2019 | Okazawa | B41J 2/18 |
| 2020/0189274 | A1 * | 6/2020 | Hayashi | B41J 2/1433 |
| 2020/0316939 | A1 * | 10/2020 | Mizuno | B41J 2/14233 |
| 2020/0316942 | A1 * | 10/2020 | Mizuno | B41J 2/14032 |

FOREIGN PATENT DOCUMENTS

JP 2018-130967 A 8/2018

* cited by examiner

*Primary Examiner* — Justin Seo
(74) *Attorney, Agent, or Firm* — Scully, Scott, Murphy & Presser, P.C.

(57) ABSTRACT

A head includes a plurality of individual channels, a first common channel, and a second common channel. The plurality of individual channels are arranged in a first row in a first direction. The plurality of individual channels are arranged in a second row in a second direction. The first direction and the second direction intersect each other. The first common channel extends in the first direction and is fluidly communicated the plurality of individual channels. The second common channel extends in the first direction. The second common channel is fluidly communicated the plurality of individual channels and overlaps the first common channel in a third direction. The third direction is orthogonal to both the first direction and the second direction.

20 Claims, 7 Drawing Sheets

HEAD

CROSS-REFERENCE TO RELATED APPLICATION

This application claims priority from Japanese Patent Application No. 2018-236110 filed on Dec. 18, 2018, the content of which is incorporated herein by reference in its entirety.

TECHNICAL FIELD

Aspects described herein relate to a head that ejects droplets of liquid from nozzles.

BACKGROUND

Liquid ejection heads are used to eject a variety of liquids from nozzles. Examples of the liquid ejection heads include an inkjet head that ejects ink droplets from nozzles. The inkjet head includes individual ink channels each having a nozzle and a pressure chamber. The individual ink channels are arranged in a first direction and formed in two rows next to each other in a second direction orthogonal to the first direction. The inkjet head includes a supply manifold and a return manifold, which are provided for each row of the individual ink channels. The supply manifold and the return manifold overlap each other in a third direction orthogonal to both of the first and second directions. In known liquid ejection heads, the pressure chambers constituting each row of the individual ink channels communicate with the supply manifold via restrictors and the return manifold via other restrictors.

SUMMARY

In the above inkjet head, the supply manifold and the return manifold overlap in the third direction. However, the supply manifold and the return manifold are provided for each row of individual ink channels. In other words, the inkjet head includes two rows of individual ink channels, two supply manifolds, and two return manifolds. The supply manifolds and the return manifolds of the two rows of individual ink channels have respectively different positions in the second direction. This prevents the inkjet head from downsizing in the second direction.

One or more aspects of the disclosure provide a downsized liquid ejection head. According to an aspect of the disclosure, a head includes a plurality of individual channels, a first common channel, and a second common channel. The plurality of individual channels are arranged in a first row in a first direction. The plurality of individual channels are arranged in a second row in a second direction. The first direction and the second direction intersect each other. The first common channel extends in the first direction and is fluidly communicated the plurality of individual channels. The second common channel extends in the first direction. The second common channel is fluidly communicated the plurality of individual channels and overlaps the first common channel in a third direction. The third direction is orthogonal to both the first direction and the second direction.

DETAILED DESCRIPTION

An embodiment is described with reference to the accompany drawings.

Structure of Printer

Figure 1:
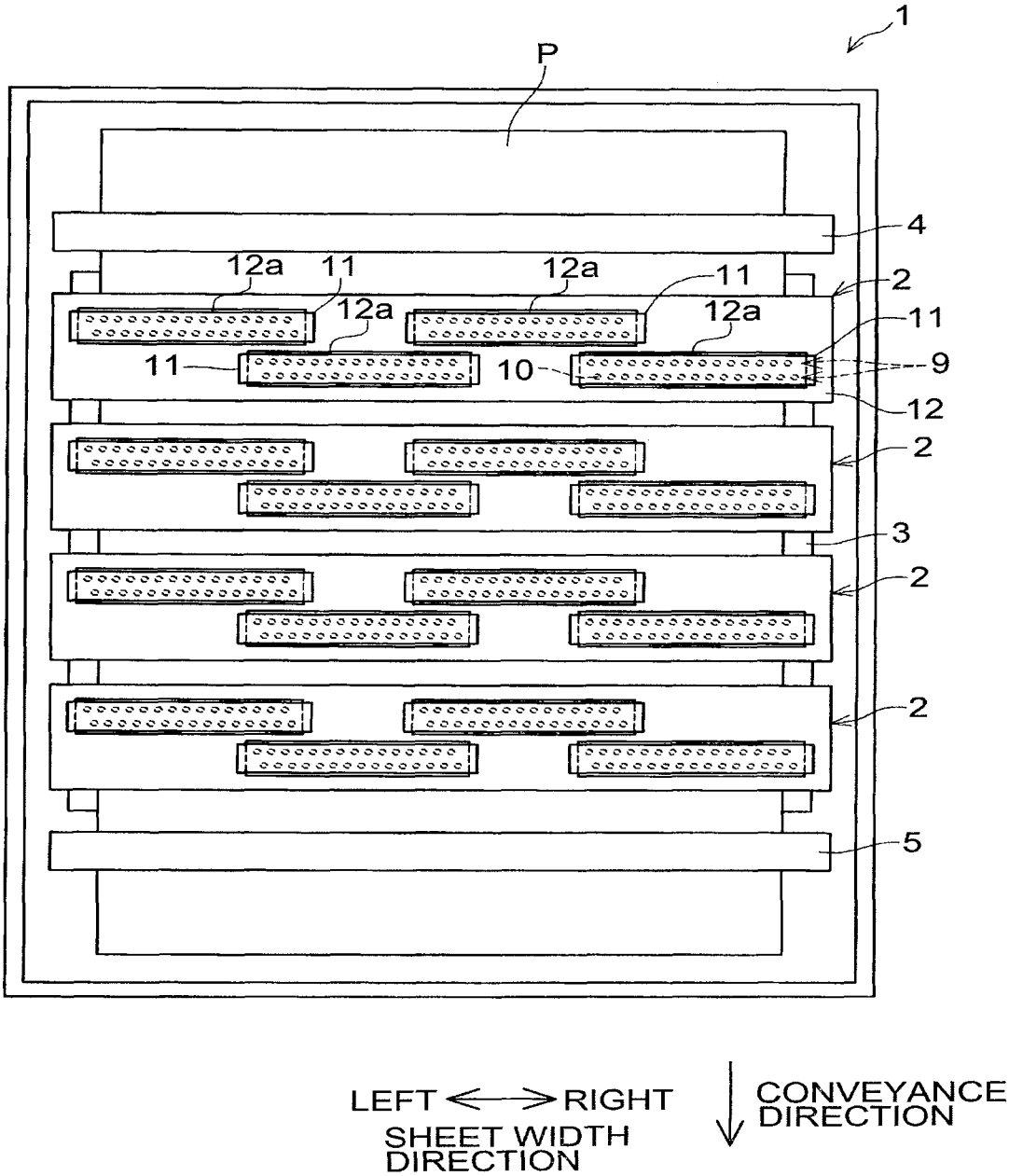
FIG. 1 is a schematic diagram of a printer according to an embodiment of the disclosure.

As illustrated in FIG. 1, a printer 1 according to the embodiment includes four inkjet heads 2, a platen 3, and conveyor rollers 4, 5.

The four inkjet heads 2 are arranged horizontally in a conveyance direction (as an example of a second direction) in which a recording sheet P is conveyed by conveyor rollers 4, 5. Each of the inkjet heads 2 includes four head units 11 (as an example of a liquid ejection head) and a holding member 12. The head units 11 have their lower surfaces with nozzles 10 for ejecting ink droplets. In this embodiment, first, second, third, and fourth inkjet heads 2, which are arranged in the order from upstream to downstream in the conveyance direction, and can each correspond to an ink color, such as one of black, yellow, cyan, and magenta.

The nozzles 10 of each head unit 11 are spaced from one another in a sheet width direction (as an example of a first direction), forming a nozzle row 9. Each head unit 11 has two nozzle rows 9 next to each other in the conveyance direction. The nozzles 10 of the two nozzle rows 9 have different positions in the sheet width direction by half the distance between any two nozzles 10 located next to each other in the sheet width direction. The following description is made based on the right and left sides of the printer 1 in the sheet width direction.

In each of the inkjet heads 2, two of the four head units 11 are spaced apart from each other in the sheet width direction. The two of the four head units 11 aligned in the sheet width direction are spaced apart from the remaining two head units 11 in the conveyance direction. The two upstream head units 11 are offset from the two downstream head units 11 in the sheet width direction. The nozzles 10 in an upstream head unit 11 partially overlap the nozzles 10 in a downstream head unit 11 in the conveyance direction. Thus, the nozzles 10 of the four head units 11 are located throughout the entire length of a recording sheet P in the sheet width direction. In other words, the inkjet heads 2 are line heads extending along the entire length of a recording sheet P in the sheet width direction.

The holding member 12 is a plate-like member having a shape of rectangle elongated in the sheet width direction. The holding member 12 has four head units 11 fixed thereto. The holding member 12 has four through holes 12*a* each corresponding to one of the four head units 11. The nozzles 10 of each of the head units 11 are exposed downward (toward a recording sheet P) via a corresponding one of the through holes 12*a*.

The platen 3 is disposed below the inkjet heads 2 and faces the nozzles 10 of the inkjet heads 11. The platen 3 supports a recording sheet P. The conveyor roller 4 is disposed upstream from the inkjet heads 2 and the platen 3 in the conveyance direction. The conveyor roller 5 is disposed downstream from the inkjet heads 2 and the platen 3 in the conveyance direction. The conveyor rollers 4, 5 convey a recording sheet P in the conveyance direction.

The printer 1 controls the conveyor rollers 4, 5 to convey a recording sheet P in the conveyance direction and the four inkjet heads 2 to eject ink from the nozzles 10 of the respective four head units 11, thereby recording an image on the recording sheet P.

Head Unit

Figure 2:
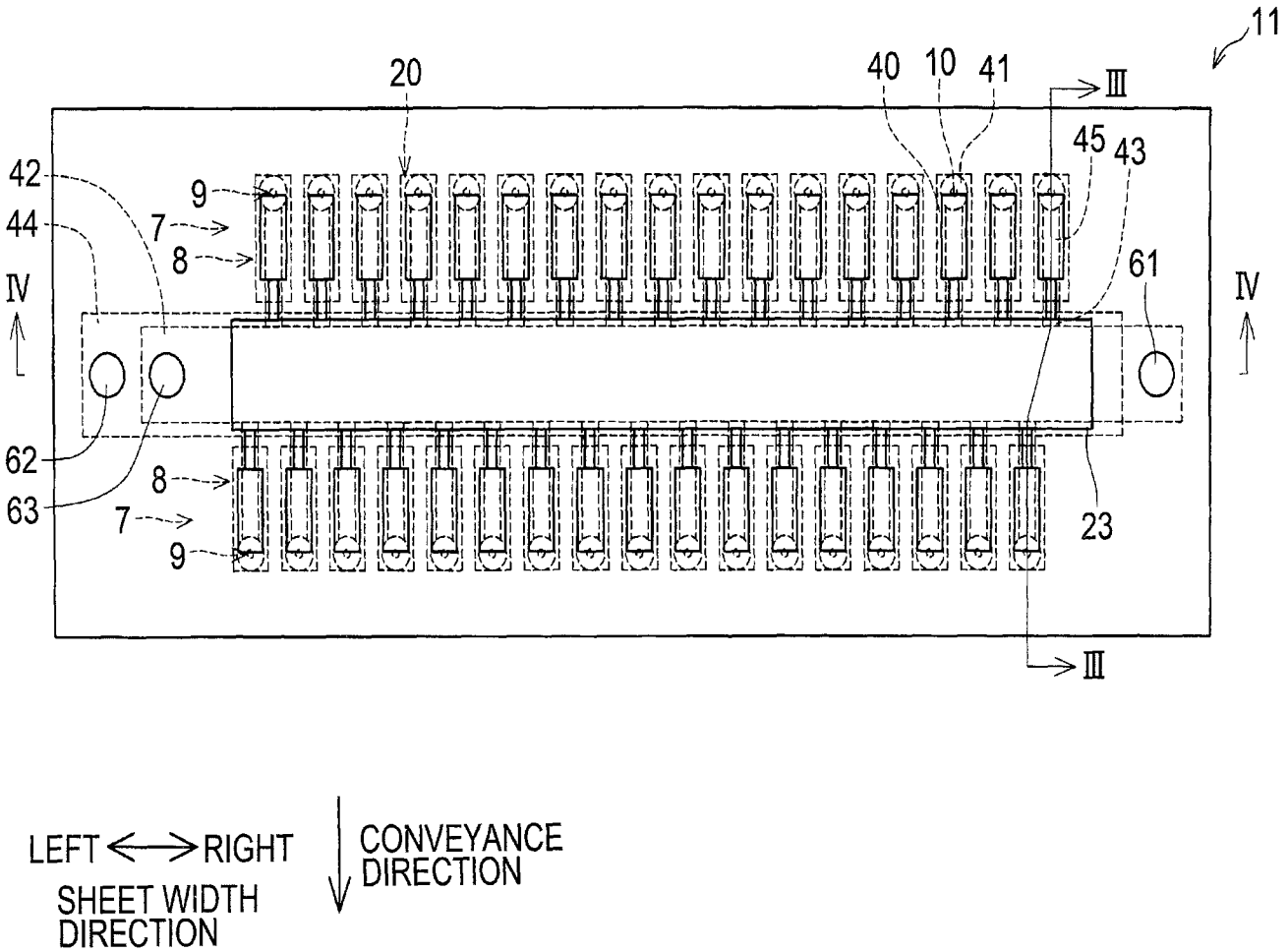
FIG. 2 is a plan view of a head unit included in the printer.
Figure 3:
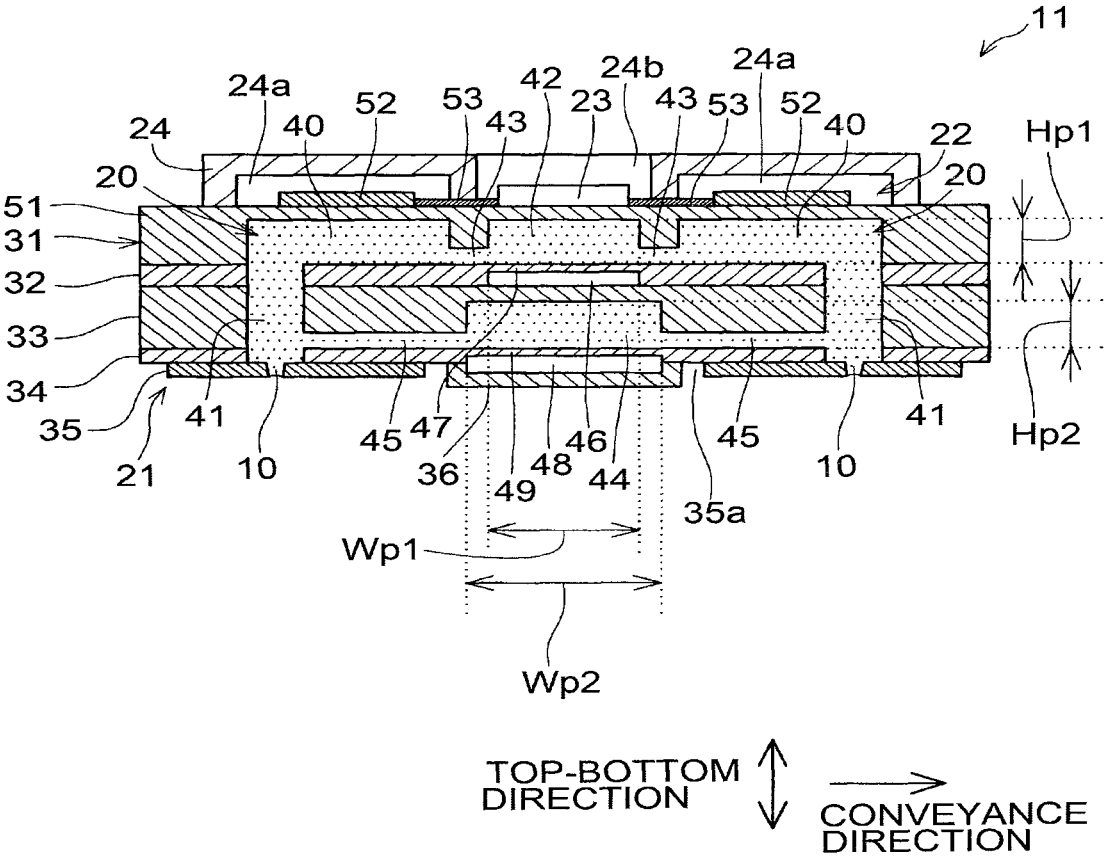
FIG. 3 is a sectional view taken along a line III-III of FIG. 2.
Figure 4:
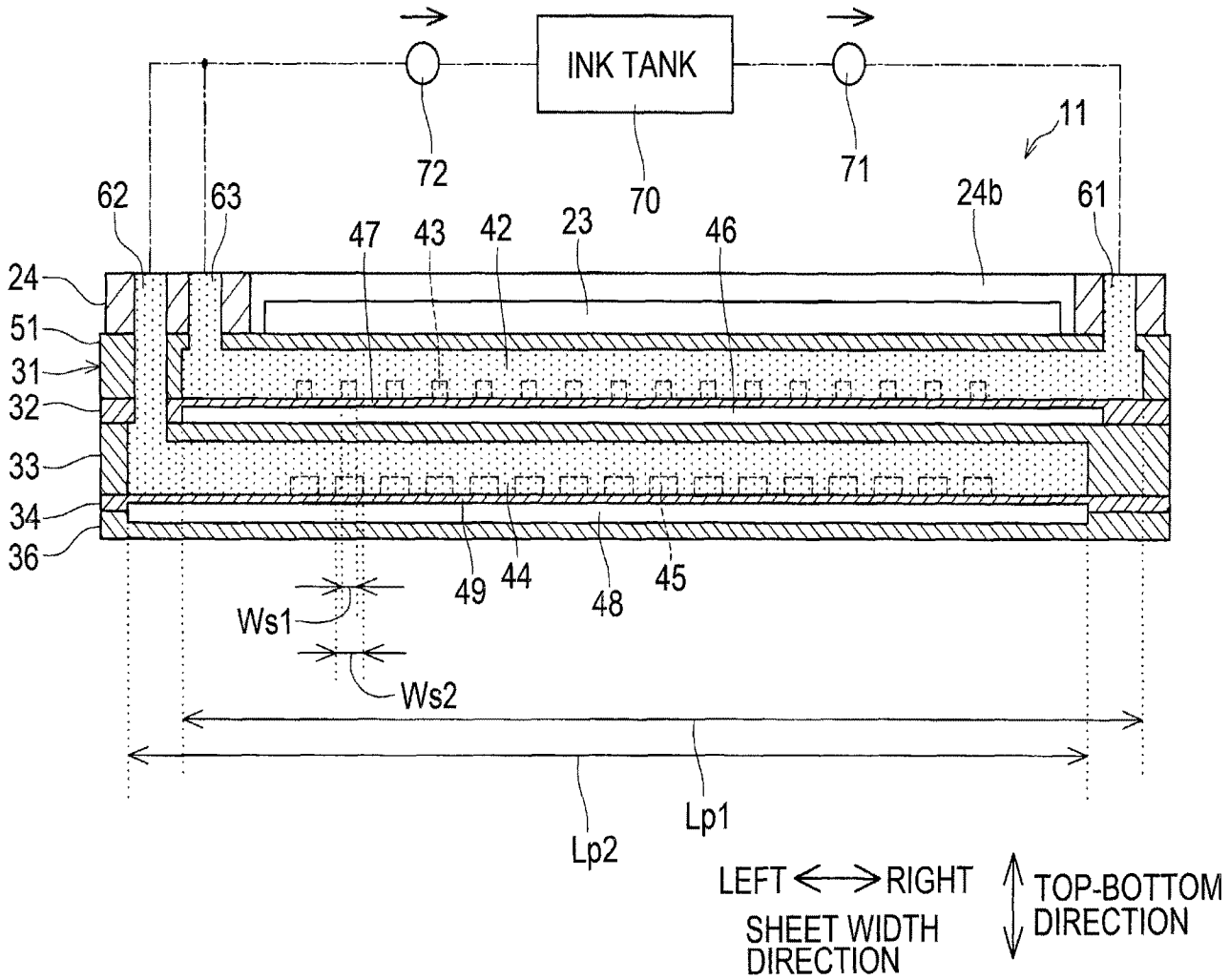
FIG. 4 is a sectional view taken along a line IV-IV of FIG. 2.

The head units 11 are described. As illustrated in FIGS. 2, 3, and 4, a head unit 11 includes a channel unit 21 in FIG. 3, a piezoelectric actuator 22 in FIG. 3, an IC driver 23 in FIGS. 2, 3, and 4, and a cover plate 24 in FIGS. 3 and 4.

Channel Unit

The channel unit 21 is formed by laminated plates 31, 32, 33, 34, 35, and 36 joined to one another. The plates 31, 32, 33, and 34 may be made of can be made of any suitable material such as silicone (Si), Si containing materials, carbon, carbon based materials, metals, and combinations thereof and laminated one on another from above in this order in the top-bottom direction. The plate 35 may be made of a synthetic resin and joined to a lower surface of the plate 34. The plate 35 has, in its central portion, a through hole 35*a* extending in the sheet width direction (sheet width direction shown in FIGS. 2 and 4). The plate 36 may be made of silicone (Si) and joined to a portion of a lower surface of the plate 34 exposed from the through hole 35*a*.

The channel unit 21 includes a plurality of nozzles 10, a plurality of pressure chambers 40, a plurality of descenders 41, a first common channel 42, a plurality of first narrowed portions 43, a second common channel 44, and a plurality of second narrowed portions 45.

The nozzles 10 are formed in the plate 35. The nozzles 10 form two nozzle rows 9 as described above.

The pressure chambers 40 are each paired with one of the nozzles 10 and formed in the plate 31. The pressure chambers 40 extend a distance in the top-bottom direction from the plate 31 to the descenders 41 and extend a distance in the conveyance direction from a first portion of the plate 31 to a second portion of the plate 31. The pressure chambers 40 are formed by recesses of the plate 31, which are open downward. Pressure chambers 40, paired with nozzles 10 in an upstream nozzle row 9 in the conveyance direction, have their upstream end portions overlapping the nozzles 10 in a top-bottom direction. Pressure chambers 40, paired with nozzles 10 in a downstream nozzle row 9 in the conveyance direction, have their downstream end portions overlapping the nozzles 10 in a top-bottom direction. The pressure chambers 40 thus form two pressure-chamber rows 8 corresponding to the two nozzle rows 9.

Continuing to refer to FIG. 3, the descenders 41 are each paired with one of the nozzles 10. The descenders 41 are formed by through holes in the plates 32, 33, and 34, which are aligned with one another in the top-bottom direction. Each of the descenders 41 extends in the top-bottom direction to communicate with a corresponding one of the nozzles 10 and a corresponding one of the pressure chambers 40.

The first common channel 42 extending in the sheet width direction and fluidly communicated the plurality of individual channels 20. The plurality of individual channels 20 are arranged in a first row in the sheet width direction. The plurality of individual channels 20 are arranged in a second row in the conveyance direction. The first common channel 42 is between the pressure chambers 40 arranged in the conveyance direction. In detail, the first common channel 42 is formed in a portion of the plate 31 located between the two pressure-chamber rows 8 in the conveyance direction. The first common channel 42 overlaps the pressure chambers 40 in the conveyance direction. The first common channel 42 is formed by a recess of the plate 31 (as an example of a third recess), which is open downward in the top-bottom direction. The first common channel 42 extends over the pressure chambers 40 forming a pressure-chamber row 8 in the sheet width direction. The first common channel 42 supplies the plurality of individual channels 20.

The first common channel 42 overlaps, in the top-bottom direction, a damper chamber 46 formed in a lower portion of the plate 32. The damper chamber 46 is formed by a recess of the plate 32, which is open downward in the top-bottom direction. The plate 32 has a thin portion located between the first common channel 42 and the damper chamber 46 in the top-bottom direction, which is thinner than other portion of the plate 32. The thin portion functions as a damper 47 (as an example of a second damper), which is elastically deformable. The elastic deformation of the damper 47 reduces fluctuations of ink pressure in the first common channel 42. The damper 47 and the plate 31 define the first common channel 42. The plate 32 is adhered to the plate 31.

The first narrowed portions 43 are each paired with one of the pressure chambers 40, and each of the first narrowed portions 43 are narrower than pressure chambers 40 and the first common channel 42. Each of the first narrowed portions 43 is formed in a lower portion of the plate 31 and extends in the conveyance direction to communicate with a corresponding pressure chamber 40 and the first common channel 42. Each of the first narrowed portions 43 is formed by a recess of the plate 31 (as an example of a first recess), which is open downward in the top-bottom direction and of a shorter in the top-bottom direction than the pressure chamber 40 and the first common channel 42.

The second common channel 44 is between the descending channels 41 in the conveyance direction. In detail, the second common channel 44 is formed in a portion of the plate 33 located between the two descending channel rows in the conveyance direction. The second common channel 44 is formed in a portion of the plate 33 overlapping the first common channel 42 in the top-bottom direction. The second common channel 44 is formed by a recess of the plate 33 (as an example of a fourth recess), which is open downward. The second common channel 44 extends in the sheet width direction (sheet width direction shown in FIGS. 2 and 4) over the pressure chambers 40 forming a pressure-chamber row 8. As illustrated in FIGS. 2 and 4, the first common channel 42 is narrower than the second common channel 44 in the conveyance direction and is within opposing edges of the second common channel 44 in the conveyance direction. In other words, the second common channel 44 extends to the left further than the first common channel 42 in the sheet width direction. The first common channel 42 extends to the right further than the first common channel 44 in the sheet width direction. The second common channel 42 is in fluid communication with the individual channels 20. The second common channel 44 is configured to collect ink from the plurality of individual channels 20.

As illustrated in FIG. 3, in the conveyance direction, the second common channel 44 has a dimension Wp2, which is greater than a dimension Wp1 of the first common channel 42. In the top-bottom direction, the first common channel 42 has a dimension Hp1, which is substantially the same as a dimension Hp2 of the first common channel 44. As illustrated in FIG. 4, the first common channel 42 has a dimension Lp1, which is substantially the same as a dimension Lp2 of the first common channel 44 in the sheet width direction. The second common channel 44 thus has a greater capacity than the first common channel 42 has. Provided that the second common channel 44 has a greater capacity than the first common channel 42 has, the dimensions Hp1, Hp2 may be different, and the dimensions Lp1, Lp2 may be different.

In the conveyance direction, both ends of the first common channel 42 are located between both ends of the second common channel 44. In other words, in the conveyance direction, the second common channel 44 has an upstream end located upstream from an upstream end of the first common channel 42, and a downstream end located downstream from a downstream end of the first common channel 42.

The second common channel 44 overlaps, in the top-bottom direction, a damper chamber 48 formed between a lower portion of the plate 34 and an upper portion of the plate 36. The damper chamber 48 is formed by a recess of the plate 34, which is open downward in the top-bottom direction, and a recess of the plate 36, which is open upward in the top-bottom direction. The plate 34 has a thin portion, which is thinner than other portion of the plate 34, located between the second common channel 44 and the damper chamber 48. The thin portion functions as a damper 49 (as an example of a first damper), which is elastically deformable. The elastic deformation of the damper 49 reduces fluctuations of ink pressure in the second common channel 44. The plate 34 is adhered to the plate 33. The damper 49 and the plate 33 define the second common channel 44.

The second narrowed portions 45 are each paired with one of the descenders 41, each of the second narrowed portions 45 being narrower the second common channel 44, and are each formed in a lower portion of the plate 33. The second narrowed portions 45 are formed by recesses of the plate 33, which are open downward in the top-bottom direction. Each of the second narrowed portions 45 extends in the conveyance direction to communicate with a lower end portion of a corresponding descending channel 41 (toward a corresponding nozzle 10) and the second common channel 44.

As illustrated in FIG. 4, each of the second narrowed portions 45 has a dimension Ws2, which is greater in the sheet width direction than a dimension Ws1 of a corresponding one of the first narrowed portions 43. Both ends of each first narrowed portion 43 in the sheet width direction are located between both ends of a corresponding second narrowed portion 45. In other words, in the sheet width direction, the right end of each second narrowed portion 45 is located further to the right than the right end of a corresponding first narrowed portion 43, and the left end of the second narrowed portion 45 is located further to the left than the left end of the first narrowed portion 43.

In the embodiment, the first narrowed portions 43 and the second narrowed portions 45 have greater resistance to liquid flow than the descenders 41. In other words, the descenders 41, the first narrowed portions 43, and the second narrow portions 45 are sized to satisfy the above relationship in resistance to liquid flow. The descenders 41 each have a determined downward dimension in the top-bottom direction and an area of cross section orthogonal to the top-bottom direction. The first narrowed portions 43 each have a determined dimension in the conveyance direction and an area of cross section orthogonal to the conveyance direction. The second narrow portions 45 each have a determined dimension in the conveyance direction and an area of cross section orthogonal to the conveyance direction. Thus, the area of cross section of the descenders 41 is larger than both the area of cross section of the first narrowed portions 43 and the area of cross section of the second narrowed portions 45.

In the channel unit 21, a nozzle 10, a pressure chamber 40, a descending channel 41, a first narrowed portion 43, and a second narrowed portion 45 communicate with each other, forming an individual channel 20. The channel unit 21 has the plurality of individual channels 20 in the conveyance direction and the sheet width direction. In detail, the channel unit 21 has two individual-channel rows 7 located next to each other in the conveyance direction, each row including the individual channels 20 aligned in the sheet width direction.

In this embodiment, the plate 35 is an example of a nozzle plate. The plate 31 includes a recess defining each pressure chamber 40, a recess defining the first common channel 42, and a recess defining each first narrowed portion 43, which are, respectively, examples of a first channel member, a fourth channel member, and a first common channel member. The plate 33 includes a through hole partially defining each descending channel 40, a recess defining the first common channel 44, and a recess defining each second narrowed portion 45, which are, respectively, examples of a second channel member, a third channel member, and a second common channel member. The plate 34 including the damper 49 is an example of a first damper member. The plate 32 including the damper 47 is an example of a second damper member.

Piezoelectric Actuator

The piezoelectric actuator 22 includes a vibration plate 51 and a plurality of piezoelectric elements 52 (as an example of a drive element). The vibration plate 51 is made of, for example, silicon dioxide ($SiO_2$) or silicon nitride (SiN). The vibration plate 51 is formed by oxidizing or nitriding an upper portion of the plate 31. The vibration plate 51 covers the pressure chambers 40 and the first common channel 42.

The piezoelectric elements 52 are each paired with one of pressure chambers 40. The piezoelectric elements 52 are disposed at portions of the upper surface of the vibration plate 51, which overlap the respective pressure chambers 40 in the top-bottom direction. The piezoelectric elements 52 include electrodes and piezoelectric members, which are made of a piezoelectric material having, as the main ingredient, lead zirconate titanate, which is a mixed crystal of lead titanate and lead zirconate. Each of the piezoelectric elements 52 alters the shape of a corresponding pressure chamber 40 such that, when a piezoelectric member becomes deformed, the piezoelectric element 52 and a portion of the vibration plate 51, which overlaps the pressure chamber 40 in the top-bottom direction, become deformed and cause a portion of the vibration plate 51 between portions of plate 31 in the conveyance direction, to protrude into the pressure chamber 40. The pressure chamber 40 is thus reduced in volume and the pressure of ink in the pressure chamber 40 rises, so that ink is ejected from a nozzle 10 communicating with the pressure chamber 40. The piezoelectric elements 52 are similar in structure and operation to known ones, and thus the detailed description thereof is omitted.

Driver IC

The driver IC 23 is disposed at a portion of the upper surface of the vibration plate 51, which overlaps the first common channel 42 in the top-bottom direction. The driver IC 23 is connected to the electrodes, which are not illustrated, of the piezoelectric elements 52 via respective wires 53 disposed on the upper surface of the vibration plate 51.

Cover Plate

The cover plate 24 is disposed on the upper surface of the vibration plate 51 having the piezoelectric actuators 52 and the IC driver 23 thereon. The cover plate 24 has two recesses 24*a* each corresponding to one of the two pressure-chamber rows 8. The recesses 24*a* extend in the sheet width direction over the respective pressure-chamber rows 8 each including the pressure chambers 40, and cover the piezoelectric elements 52 corresponding to the pressure chambers 40.

The cover plate 24 has a through hole 24*b* between the two recesses 24*a* in the conveyance direction. The through hole 24*b* extends in the sheet width direction. The driver IC 23 is disposed in the through hole 24*b*.

As illustrated in FIGS. 2 and 4, the head unit 11 includes a supply channel 61, a first discharge channel 62, and a second discharge channel 63.

The supply channel 61 is formed by through holes in the cover plate 24 and the vibration plate 51, which are aligned in the top-bottom direction with a right end of the first common channel 42, the right end of the first common channel 42 in the sheet width direction. The supply channel 61 thus communicates at its lower end with the right end of the first common channel 42. The first common channel 42 communicates with an ink tank 70 via the supply channel 61. The ink tank 70 is connected to an ink cartridge (not illustrated) via a tube (not illustrated), so that ink is supplied from the ink cartridge to the ink tank 70. A pump 71 is disposed between the ink tank 70 and the first common channel 42. The pump 71 sends ink from the ink tank 70 toward the first common channel 42. The first common channel 42 supplies the plurality of individual channels 20.

The first discharge channel 62 is formed by through holes in the cover plate 24, the vibration plate 51, and the plates 31, 32, 33, which are aligned in the top-bottom direction with a left end of the second common channel 44, the left end of the second common channel 44 in the sheet width direction. The first discharge channel 62 thus communicates at its lower end with the left end portion of the second common channel 44. The second common channel 44 communicates with the ink tank 70 via the first discharge channel 62. The first discharge channel 62 discharges liquid to the ink tank 70. The first discharge channel 62 extends in the top-bottom direction.

The second discharge channel 63 is formed by through holes in the cover plate 24 and the vibration plate 51, which are aligned in the top bottom direction with a left end of the first common channel 42, the left end of the first common channel 42 in the sheet width direction. The second discharge channel 63 thus communicates at a bottom end of the second discharge channel 63 with the left end of the first common channel 42. The first common channel 42 communicates with the ink tank 70 via the second discharge channel 63. The second discharge channel 63 extends in the top-bottom direction.

A pump 72 is disposed between the first discharge channel 62, the second discharge channel 63 and the ink tank 70. The pump 72 sends ink from the first discharge channel 62 and the second discharge channel 63 toward the ink tank 70.

The pumps 71, 72, allow ink in the ink tank 70 to flow into the first common channel 42 via the supply channel 61. Ink in the first common channel 42 mainly flows from the first narrowed portions 43 into the respective individual channels 20, and partly can be discharged from the second discharge channel 63 and returns to the ink tank 70. Ink in the individual channels 20 flows from the second narrowed portions 45 into the second common channel 44. Ink in the second common channel 44 is discharged from the first discharge channel 62 and returns to the ink tank 70. Ink is circulated between the ink tank 70 and the head unit 11 in this manner. In the embodiment, two pumps 71 and 72 are provided. In some embodiments, one of the pumps, that is, a single pump may be provided. The single pump may similarly circulate ink between the ink tank 70 and the head unit 11.

Effects

In this embodiment, the first common channel 42 and the second common channel 44 overlap each other in the top-bottom direction, and are provided for two individual-chamber rows 7. This prevents the head unit 11 from upsizing in the conveyance direction.

In this embodiment, the supply channel 61 extending in the top-bottom direction communicates with the first common channel 42 extending in the sheet width direction, thus enabling supply of ink in the ink tank 70 via the supply channel 61 to the first common channel 42. The first discharge channel 62 extending in the top-bottom direction communicates with the second common channel 44 extending in the sheet width direction, thus enabling discharge of ink via the first discharge channel 62 upward in the top-bottom direction toward the ink tank 70.

In this embodiment, as described above, ink is supplied from the supply channel 61 to the first common channel 42. Ink in the first common channel 42 flows via the individual channels 20 into the second common channel 44, and ink in the second common channel 44 is discharged from the first discharge channel 62. The supply channel 61 communicates with the right end of the first common channel 42, and the first discharge channel 62 communicates with the left end of the second common channel 44. Ink can be thus distributed throughout the first common channel 42 and the second common channel 44.

In this embodiment, the first common channel 42 communicates with the second discharge channel 63, so that ink in the first common channel 42 can be partly discharged from the second discharge channel 63. This enables discharge of air bubbles in the first common channel 42, through the second discharge channel 63, to reduce or prevent air bubbles from entering the individual channels 20.

In this embodiment, the right end of the first common channel 42 communicates with the supply channel 61 and the left end of the first common channel 42 communicates with the second discharge channel 63. This enables discharge of air bubbles in the first common channel 42 from the second discharge channel 63.

In this embodiment, an individual channel 20 includes a nozzle 10, a pressure chamber 40, a descending channel 41 communicating with the nozzle 10 and the pressure chamber 40, a first narrowed portion 43 communicating with the pressure chamber 40 and the first common channel 42, and a second narrowed portion 45 communicating with the descending channel 41 and the second common channel 44. Ink supplied in the first common channel 42 flows through the first narrowed portion 43, the pressure chamber 40, the descending channel 41, the second narrowed portion 45, and the second common channel 44. Thus, ink can be circulated in the individual channel 20.

In this embodiment, the first common channel 42 is located between the two individual-chamber rows 7 and overlaps the pressure chambers 40 in the conveyance direction. Each of the second narrowed portions 43 extends in the conveyance direction and communicates with a corresponding one of the pressure chambers 40 and the first common channel 42. The second common channel 44 is located between the two individual-chamber rows 7 and overlaps the lower end portions of the descenders 41 in the conveyance direction. Each of the second narrowed portions 45 extends in the conveyance direction and communicates with a lower end portion of a corresponding descending channel 41 and the second common channel 44. When ink flows through the first common channel 42, the first narrowed portions 43, the pressure chambers 40, the descenders 41, the second narrowed portions 45, and the second common channel 44, ink can be distributed throughout the individual channels 20 and thus circulated in the individual channels 20.

In the embodiment, the first narrowed portions 43 and the second narrowed portions 45 have greater resistance to liquid flow than the descenders 41. Due to this relationship, when a piezoelectric element 52 is driven to apply pressure to ink in a corresponding pressure chamber 40, the pressure applied to ink in the pressure chamber 40 does not escape or nearly does not escape to a first narrowed portion 43 and a second narrowed portion 45, and thus ink can be ejected from a corresponding nozzle 10.

In this embodiment, the first common channel 42 and the damper chamber 46 are formed by the recesses of the plates 31, 32, which are open downward. The second common channel 44 and the damper chamber 48 are formed by the recesses of the plates 33, 34, which are open downward. In the conveyance direction, both ends of the first common channel 42 and the damper chamber 46 are located between both ends of the second common channel 44 and the damper chamber 48. To laminate and join the plates 31-36 to one another, loads can be applied to portions of the plates 31-36 defining the first common channel 42 and the second common channel 44.

Figure 5:
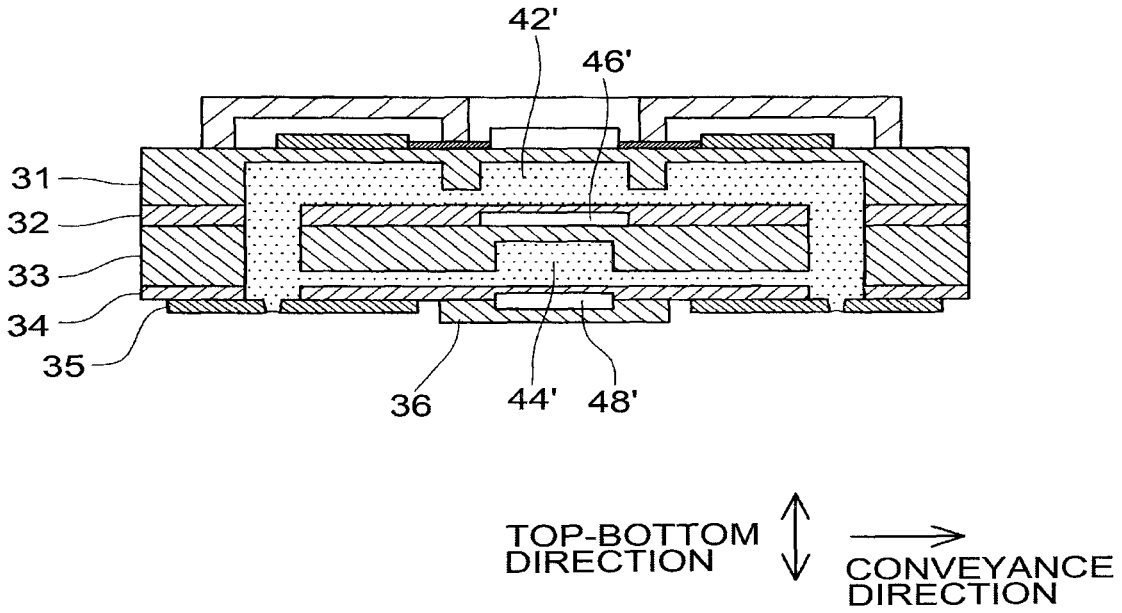
FIG. 5 is a sectional view of another embodiment of a head unit where a first common channel has a wider width than a second common channel in a conveyance direction.

As opposed to the configuration of the embodiment shown in FIGS. 3 and 4, FIG. 5 illustrates an embodiment with a configuration where, in the conveyance direction, both ends of a second common channel 44' and both ends of a corresponding damper chamber 48' are located between both ends of a first common channel 42' and both ends of a damper chamber 46'. The plates 31-34, and 36 have portions overlapping the first common channel 42' in the top-bottom direction. When the plates 31-36 are laminated and joined to one another, loads may not be applied to the portions.

In this embodiment, the first narrowed portions 43 are formed by the recesses of the plate 31, which are open downward in the top-bottom direction, and the second narrowed portions 45 are formed by the recesses of the plate 33, which are open downward in the top-bottom direction. Both ends of each first narrowed portion 43 in the sheet width direction are located between both ends of a corresponding second narrowed portion 45. Due to this relationship, to laminate and join the plates 31-36 to one another, loads can be applied to the portions of the plates 31-36 defining the first narrowed portions 43 and the second narrowed portions 45.

Figure 6:
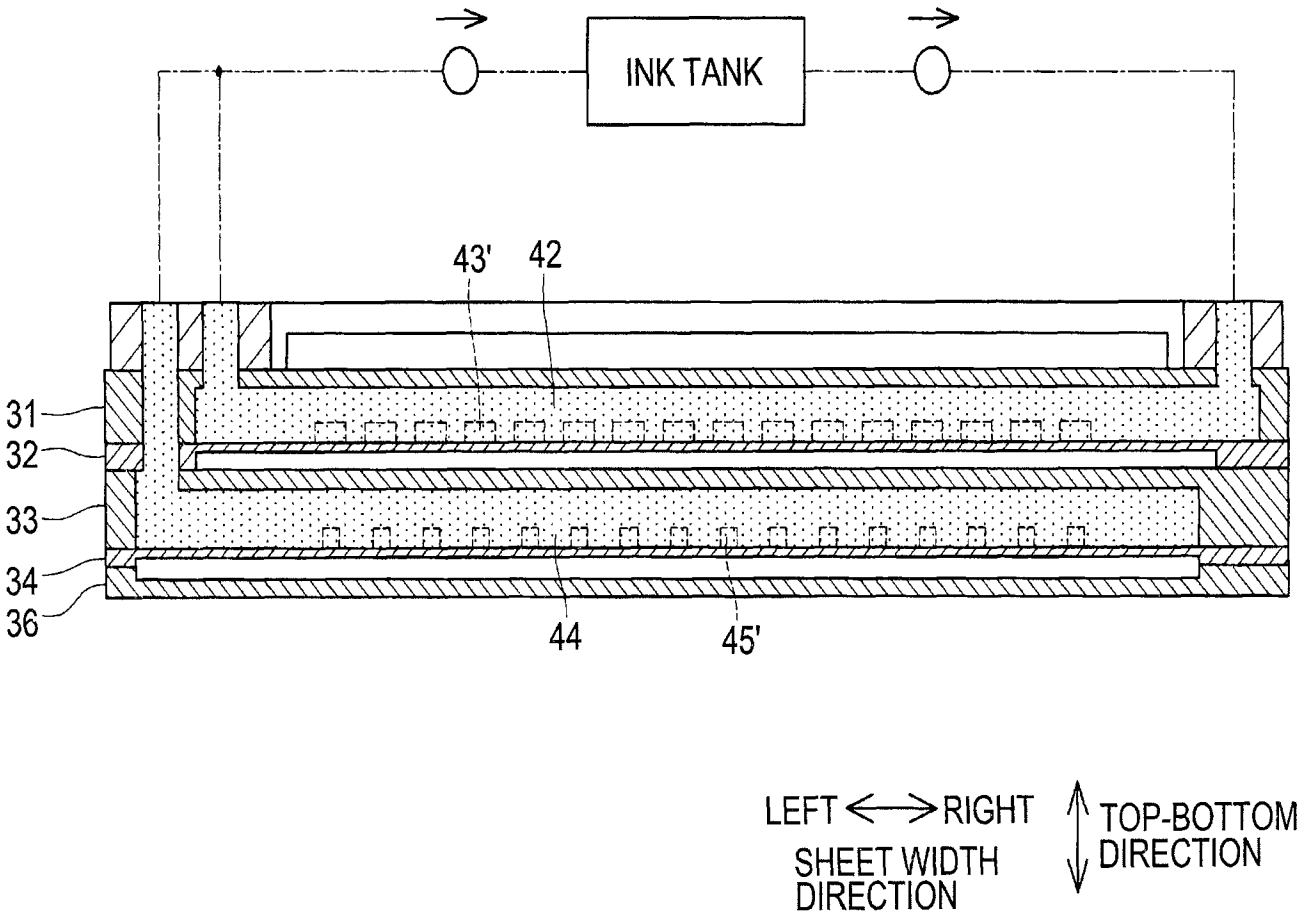
FIG. 6 is a sectional view of another embodiment of a head unit where first narrowed portions each have a wider width than second narrowed portions in a sheet width direction.

As opposed to the configuration of the embodiment shown in FIGS. 3 and 4, and as opposed to the configuration of the embodiment shown in FIG. 5, FIG. 6 illustrates a configuration where, in the sheet width direction, both ends of each second narrowed portion 45' are located between both ends of a corresponding first narrowed portion 43'. The plates 31-36 have portions overlapping the first narrowed portion 43' in the top-bottom direction. When the plates 31-36 are laminated and joined to one another, loads may not be applied to the portions.

In this embodiment, as described above, the elastic deformation of the damper 47 reduces fluctuations of ink pressure in the first common channel 42, thus stabilizing ink pressure in the first common channel 42. In this embodiment, as described above, the elastic deformation of the damper 49 reduces fluctuations of ink pressure in the second common channel 44, thus stabilizing ink pressure in the second common channel 44. This provides stable ejection of ink droplets from a nozzle 10 when a piezoelectric element 52 is driven to apply pressure to ink in a corresponding pressure chamber 40.

In this embodiment, the plate 35 having the nozzles 10 therein and the plate 36 having a recess defining the damper chamber 48 are joined to the lower surface of the plate 34 in the top-bottom direction. The plate 36 thus protrudes downward from the lower surface of the plate 34, in the top-bottom direction, further than the plate 35. Consequently, the plate 36 serves as a nozzle guard that protects the nozzles 10 from, for example, contact with a recording sheet P being raised during conveyance.

Conversely to each embodiment disclosed herein, in an alternative embodiment (not specifically illustrated) a damper might be disposed above the second common channel 44 to reduce fluctuations of pressure to be applied to ink in the second common channel 44. In this embodiment the channel unit 21 can include a space for a damper chamber in a central portion in the top-bottom direction.

In this alternative embodiment, the damper 49 and the damper chamber 48 are provided at the lower end portion in the top-bottom direction of the channel unit 21 to reduce fluctuations of pressure to be applied to ink in the second common channel 44. This can increase the rigidity of the channel unit 21.

In this alternative embodiment, the driver IC 23 is disposed at a portion of the vibration plate 51, which overlaps the first common channel 42 in the top-bottom direction. The driver IC 23 can undergo cooling by ink flowing through the first common channel 42.

In this alternative embodiment, when ink is circulated between the head unit 11 and the ink tank 70, air bubbles having entered the first common channel 42 may flow via the individual channels 20 to the second common channel 44. Air bubbles having flowed from the nozzles 10 to the individual channels 20 may then enter the second common channel 44. Thus, air bubbles tend to accumulate in the second common channel 44 more than in the first common channel 42. The second common channel 44 is larger than the first common channel 42. In this embodiment, the second common channel 44 has a greater capacity and a smaller resistance to liquid flow than the first common channel 42. This reduces fluctuations of ink pressure in the second common channel 44 and the individual channels 20 communicating with the second common channel 44, thus making an ink meniscus, that may have formed in the nozzle 10, less prone to destruction.

The above, alternative embodiment is merely an example. Various changes, arrangements and modifications may be applied therein without departing from the spirit and scope of the disclosure.

In the above, alternative embodiment, the second common channel 44 has a greater capacity than the first common channel 42 has. In some embodiments, the second common channel 44 may have a capacity equal to or smaller than the first common channel 42 has.

Figure 7:
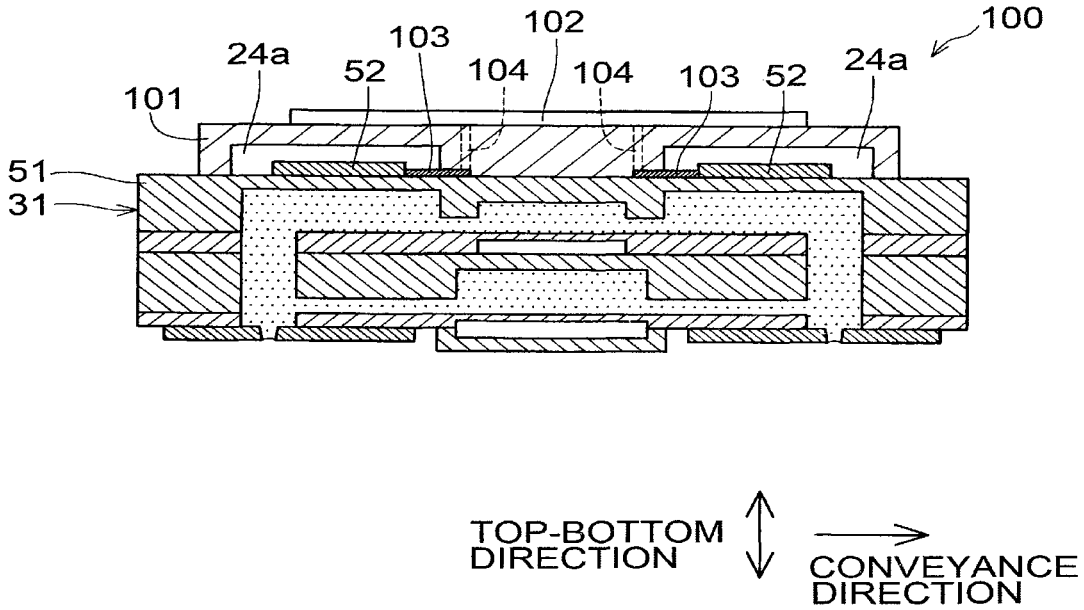
FIG. 7 is a sectional view of another embodiment of a head unit according to an alternative embodiment of the disclosure.

In the above, alternative embodiment, the driver IC 23 is disposed on the upper surface of the vibration plate 51. In an alternative embodiment illustrated in FIG. 7, a head unit 100 includes a cover plate 101 similar to the cover plate 24. The cover plate 101 has two recesses 24*a* but does not have a through hole 24*b*. A driver IC 102 is disposed on an upper surface of the cover plate 101. In the alternative embodiment, the piezoelectric elements 52 are connected to the driver IC 102 via wires 103 disposed on the upper surface of the vibration plate 51 and connected to the respective piezoelectric elements 52, and wires 104 extending vertically through the cover plate 101 and connected to the respective wires 103 driver IC 102.

The channel unit 21 has a central portion in the conveyance direction in which the first common channel 42 and the second common channel 44 overlap each other in the top-bottom direction. When the driver IC 23 is joined to the upper surface of the vibration plate 51 formed by the upper portion of the plate 31, the channel unit 21 may be fractured by a load applied to the driver IC 23.

In the above, alternative embodiment, the driver IC 102 is disposed on the upper surface of the cover plate 101. As the driver IC 102 is joined to the cover plate 101, the channel unit 21 may not be fractured by a load applied to the driver IC 102.

In the above, alternative embodiment, the first common channel 42 is located above the damper 47 in the top-bottom direction for reducing fluctuations of ink pressure in the first common channel 42 and its associated damper chamber 46. In some embodiments, the damper and its associated damper chamber may be located above the first common channel 42 in the top-bottom direction. The channel unit may include no damper for reducing fluctuations of ink pressure in the first common channel 42.

In the above embodiment, the plate 35 having the nozzles 10 therein and the plate 36 having a recess defining the damper chamber 48 are disposed on the bottom surface of the plate 34 in the top-bottom direction. In some embodiments, the entire bottom surface of the plate 34 may be joined to a first plate having a recess defining a damper chamber and through holes each partially defining a descending channel, and the first plate may be joined at its bottom surface to a second plate having nozzles 10.

The second common channel 44 is located above the damper 49 in the top-bottom direction for reducing fluctuations of ink pressure in the second common channel 44 and its associated damper chamber 48. In some embodiments, the damper and its associated damper chamber may be disposed above the second common channel 44 in the top-bottom direction. The channel unit may include no damper for reducing fluctuations of ink pressure in the first common channel 44.

In the above embodiment, in the sheet width direction, both ends of a first narrowed portion 43 are located between both ends of a second narrowed portion 45. In some embodiments, in the sheet width direction, both ends of the first narrowed portion 43 may be located at the same positions as the second narrowed portion 45, or both ends of the second narrowed portion 45 may be located between both ends of the first narrowed portion 43.

In the above embodiment, in the conveyance direction, both ends of the first common channel 42 are located between both ends of the second common channel 44. In some embodiments, in the conveyance direction, both ends of the first common channel 42 may be located at the same positions as the second common channel 44, or both ends of the second common channel 44 may be located between both ends of the first common channel 42.

In the above embodiment, the first common channel 42 and the second common channel 44 are each defined by a recess in a corresponding one of the plates. In some embodiments, at least one of the first common channel 42 and the second common channel 44 may be defined by a recess of a plate, which is open upward in the top-bottom direction, or a through hole in the plate.

In the above embodiment, in the conveyance direction, a center of the first common channel 42 is at substantially the same position as a center of the second common channel 44. In some embodiments, in the conveyance direction, an upstream portion of one of the first common channel 42 and the second common channel 44 may overlap, in the top-bottom direction, a downstream portion of the other one of the first common channel 42 and the second common channel 44. In other words, in the conveyance direction, the center of the first common channel 42 may be at a position away from the center of the second common channel 44.

In the above embodiments, the first common channel 42 and the second common channel 44 are located between the two pressure-chamber rows 7 in the conveyance direction. The pressure chambers 40 and the first common channel 42 overlap each other in the conveyance direction, and communicate with each other via the first narrowed portions 43 extending in the conveyance direction. The descenders 41 have their lower end portions overlapping the second common channel 44 in the conveyance direction. The lower end portions of the descenders 41 communicate with the second common channel 44 via the respective second narrowed portions 45 extending in the conveyance direction.

In some embodiments, the first common channel may be located above the two individual-chamber rows 7, and communicate with the pressure chambers 40 via the first narrowed portions extending in the top-bottom direction. Alternatively, the second narrowed portion may communicate with the second common channel 44 and upper portions of the descenders 41.

The first narrowed portions communicate with the first common channel 42 and the pressure chambers 40 and the second narrowed portions communicate with the second common channel 44 and the descenders 41. The first narrowed portions may communicate with the first common channel and portions of the individual channels 20 different from those described above. For example, the first common channel 42 is vertically above the pressure chamber 40 in the top-bottom direction and the first narrowed portion 43 extends vertically, in the top-bottom direction, between the first common channel 42 and the pressure chamber 40. In above embodiment, the supply channel 61 communicates with the right end of the first common channel 42, the first discharge channel 62 communicates with the left end of the second common channel 44, and the second discharge channel 63 communicates with the left end of the first common channel 42. In some embodiments, the supply channel 61 and the second discharge channel 63 may communicate with different portions of the first common channel 42. The first discharge channel 62 may communicate with a different portion of the second common channel. The second discharge channel 63 communicating with the first common channel 42 may be omitted.

In the above embodiment, the supply channel 61 and the second discharge channel 63 extend in the top-bottom direction, and communicate with the first common channel 42, and the first discharge channel 62 extends in the top-bottom direction and communicates with the second common channel 44. In some embodiments, the supply channel and the second discharge channel may extend horizontally in the conveyance direction and communicate with the first common channel 42. In some embodiments, the first discharge channel may extend horizontally in the conveyance direction and communicate with the second common channel 44.

In the above embodiment, ink is circulated between the head unit 11 and the ink tank 70 such that ink flows from the first common channel 42 via the individual channels 20 to the second common channel 44. In some embodiments, the pumps 71, 72 may send ink in an opposite direction such that ink flows from the second common channel 44 via the individual channels 20 to the first common channel 42.

In this case, the second common channel 44 is an example of a first common channel, and the first discharge channel 62 is an example of a supply channel. The first common channel 42 is an example of a second common channel, and the supply channel 61 is an example of a first discharge channel. In this case, the second discharge channel may communicate with the second common channel 44 instead of first common channel 42 in the above embodiment.

Ink is circulated between the head unit and the ink tank. In the above embodiment, the pump 72 may send ink from the ink tank 70 to the second common channel 44. In this case, ink may be supplied from the first common channel 42 and the second common channel 44 to the individual channels 20.

In the above embodiment, the piezoelectric elements 52 deform portions of the vibration plate 51, which overlap the respective pressure chambers 40 in the top-bottom direction. In some embodiments, the portions of the vibration plate 51 may be deformed by drive elements other than the piezoelectric elements.

The description has been made on the example in which the disclosure is applied to the head unit that ejects droplets of ink from nozzles. The disclosure may be applied to various liquid ejection heads that eject, from nozzles, liquid other than ink, for example, resin or metal in liquid form.

What is claimed is:

1. A head comprising:

a plurality of individual channels arranged in a first row in a first direction and the plurality of individual channels also arranged in at least a second row in a second direction, wherein the first direction and the second direction intersect each other;

a first common channel extending in the first direction and fluidly communicated the plurality of individual channels; and a second common channel extending in the first direction, fluidly communicated the plurality of individual channels and overlapping the first common channel in a third direction, wherein the third direction is orthogonal to both the first direction and the second direction, wherein each of the plurality of individual channels comprise:

a nozzle;

a pressure chamber overlapping the nozzle in the third direction, wherein the pressure chamber of each of the plurality of individual channels are fluidly connected, in the second direction, through the first common channel.

2. The head according to claim 1, wherein the first common channel is configured to supply a fluid to the plurality of individual channels, and the second common channel configured to collect the fluid from the plurality of individual channels.

3. The head according to claim 2, further comprising a supply channel configured to supply the liquid to the first common channel, the supply channel extending in the third direction; and a first discharge channel configured to discharge liquid to an outside of the head, the first discharge channel extending in the third direction.

4. The head according to claim 3, wherein the supply channel in fluid communication with a first end portion of the first common channel in the first direction, and the first discharge channel in fluid communication with a first end portion of the second common channel in the first direction, wherein the first end portion of the first common channel is on a side of the head opposite to the first end portion of the second common channel.

5. The head according to claim 3, further comprising a second discharge channel discharging liquid, extending in the third direction and in fluid communication with the first common channel.

6. The head according to claim 5, wherein the supply channel in fluid communication with a first end portion of the first common channel in the first direction, and the second discharge channel in fluid communication with a second end portion of the first common channel in the first direction, wherein the first end portion of the first common channel is on a side of the head opposite to the second end portion of the first common channel.

7. The head according to claim 1, wherein each of the individual channels comprises:

a descending channel extending in the third direction between the nozzle and the pressure chamber;

a first narrowed portion between the pressure chamber and the first common channel, the first narrowed portion being narrower than the pressure chamber; and a second narrowed portion between the descending channel and the second common channel, the second narrowed portion being narrower than the pressure chamber.

8. The head according to claim 7, wherein resistance to liquid flow of the first narrowed portion is higher than that of the descending channel.

9. The head according to claim 7, wherein resistance to liquid flow of the second narrowed portion is higher than that of the descending channel.

10. The head according to claim 7, wherein the plurality of individual channels comprise a plurality of pressure chambers and a plurality of descending channels, respectively, and wherein the first common channel is between each of the plurality of the pressure chambers arranged in the second direction and the first common channel overlaps the pressure chambers in the second direction, the first narrowed portion extends in the second direction between at least two of the plurality of pressure chambers and the first common channel, the second common channel is between the plurality of descending channels in the second direction and overlaps the descending channel in the second direction, and the second narrowed portion extends in the second direction between the descending channel and the second common channel.

11. The head according to claim 10, further comprising
a first plate comprising a first recess, wherein the first recess is the first narrowed portion;
a second plate including a second recess, wherein the second recess is the second narrowed portion, wherein the first plate is laminated to the second plate in the third direction; and
a nozzle plate, wherein the plurality of individual channels comprise a plurality of nozzles, wherein the nozzle plate comprises the plurality of nozzles, and wherein the nozzle plate is laminated to the second plate in the third direction.

12. The head according to claim 11;
wherein
the first recess is between the first plate and the second plate,
the second recess is between the second plate and the nozzle plate, and
the first recess overlaps the second recess in the third direction, wherein a first end of the first recess in the second direction and a second end of the first recess in the second direction are both between a first end of the second recess in the second direction and a second end of the second recess in the second direction.

13. The head according to claim 11,
wherein
the second plate comprises the descending channel and the second common channel, and
the head further comprises a first damper, wherein the first damper is adhered to the second plate, wherein the first damper and the second plate define the second common channel.

14. The head according to claim 13,
wherein the first plate comprises the first common channel, and
the head further comprises a second damper disposed between the first plate and the second plate, wherein the second damper is adhered to the first plate, wherein the second damper and the first plate define first common channel.

15. The head according to claim 11,
wherein the first plate comprises a third recess, the third recess being a portion of the first common channel; and
the second plate comprises a fourth recess, the fourth recess being a portion of the second common channel,
the third recess is between the first plate and the second plate in the third direction;
the fourth recess is between the second plate and the nozzle plate in the third direction; and
the third recess overlaps the fourth recess and wherein a first end of the third recess in the second direction and a second end of the third recess in the second direction are both between a first end of the fourth recess in the second direction and a second end of the fourth recess in the second direction.

16. The head according to claim 7, further comprising
a first plate comprising both the pressure chamber and the first common channel;
a vibration plate covering the pressure chamber in the third direction;
a piezoelectric element overlapping the pressure chamber in the third direction, wherein the piezoelectric element is disposed on the vibration plate; and
a driver overlapping the first common channel in the third direction, wherein the driver is electrically connected to the piezoelectric element.

17. The head according to claim 7, further comprising
a first plate comprising both the pressure chamber and the first common channel;
a vibration plate covering the pressure chamber in the third direction;
a piezoelectric element overlapping the pressure chamber in the third direction, wherein the piezoelectric element is disposed on the vibration plate;
a cover plate covering the piezoelectric element in the third direction, wherein the cover plate is disposed on the vibration plate; and
a driver overlapping the first common channel in the third direction, wherein the driver is disposed on the cover plate.

18. The head according to claim 2,
wherein the second common channel is larger than the first common channel.

19. A head comprising:
a plurality of individual channels arranged in a first row in a first direction and the plurality of individual channels also arranged in at least a second row in a second direction, wherein the first direction and the second direction intersect each other;
a first common channel extending in the first direction and fluidly communicated the plurality of individual channels;
a second common channel extending in the first direction, fluidly communicated the plurality of individual channels and overlapping the first common channel in a third direction, wherein the third direction is orthogonal to both the first direction and the second direction;
a first plate comprising a first recess, wherein the first recess is the first narrowed portion;
a second plate including a second recess, wherein the second recess is the second narrowed portion, wherein the first plate is laminated to the second plate in the third direction;
a nozzle plate, wherein the plurality of individual each comprise a plurality of nozzles, wherein the nozzle plate comprises the plurality of nozzles, and wherein the nozzle plate is laminated to the second plate in the third direction; and
a first damper,
wherein each of the plurality of individual channels further comprises:
a nozzle;
a pressure chamber overlapping the nozzle in the third direction;
a descending channel extending in the third direction between the nozzle and the pressure chamber;
a first narrowed portion between the pressure chamber and the first common channel, the first narrowed portion being narrower than the pressure chamber; and
a second narrowed portion between the descending channel and the second common channel, the second narrowed portion being narrower than the pressure chamber, and
wherein the plurality of individual channels each comprise a plurality of pressure chambers and a plurality of descending channels, respectively, and wherein
the first common channel is between each of the plurality of the pressure chambers arranged in the second direction and the first common channel overlaps the pressure chambers in the second direction, the first narrowed portion extends in the second direction between at least two of the plurality of pressure chambers and the first common channel, the second common channel is between the plurality of descending channels in the second direction and overlaps the descending channel in the second direction, the second narrowed portion extends in the second direction between the descending channel and the second common channel, the second plate comprises the descending channel and the second common channel, and the first damper is adhered to the second plate, wherein the first damper and the second plate define the second common channel.

20. A head comprising:

a plurality of individual channels arranged in a first row in a first direction and the plurality of individual channels also arranged in at least a second row in a second direction, wherein the first direction and the second direction intersect each other;

a first common channel extending in the first direction and fluidly communicated the plurality of individual channels;

a second common channel extending in the first direction, fluidly communicated the plurality of individual channels and overlapping the first common channel in a third direction, wherein the third direction is orthogonal to both the first direction and the second direction;

a first plate comprising a first recess, wherein the first recess is the first narrowed portion;

a second plate including a second recess, wherein the second recess is the second narrowed portion, wherein the first plate is laminated to the second plate in the third direction; and a nozzle plate, wherein the plurality of individual channels each comprise a plurality of nozzles, wherein the nozzle plate comprises the plurality of nozzles, and wherein the nozzle plate is laminated to the second plate in the third direction, wherein each of the plurality of individual further comprises:

a nozzle;

a pressure chamber overlapping the nozzle in the third direction;

a descending channel extending in the third direction between the nozzle and the pressure chamber;

a first narrowed portion between the pressure chamber and the first common channel, the first narrowed portion being narrower than the pressure chamber; and a second narrowed portion between the descending channel and the second common channel, the second narrowed portion being narrower than the pressure chamber, wherein the plurality of individual channels each comprise a plurality of pressure chambers and a plurality of descending channels, respectively, and wherein the first common channel is between each of the plurality of the pressure chambers arranged in the second direction and the first common channel overlaps the pressure chambers in the second direction, the first narrowed portion extends in the second direction between at least two of the plurality of pressure chambers and the first common channel, the second common channel is between the plurality of descending channels in the second direction and overlaps the descending channel in the second direction, the second narrowed portion extends in the second direction between the descending channel and the second common channel, the first plate comprises a third recess, the third recess being a portion of the first common channel, the second plate comprises a fourth recess, the fourth recess being a portion of the second common channel, the third recess is between the first plate and the second plate in the third direction, the fourth recess is between the second plate and the nozzle plate in the third direction, and the third recess overlaps the fourth recess and wherein a first end of the third recess in the second direction and a second end of the third recess in the second direction are both between a first end of the fourth recess in the second direction and a second end of the fourth recess in the second direction.

* * * * *